US009458382B2

(12) United States Patent
Liu et al.

(10) Patent No.: US 9,458,382 B2
(45) Date of Patent: Oct. 4, 2016

(54) TOP DRIVE MECHANISM FOR DRILL ROD

(71) Applicant: Luoyang Jianguang Special Equipment Co., Ltd., Luoyang (CN)

(72) Inventors: Zhiping Liu, Luoyang (CN); Dongfeng Yang, Luoyang (CN); Wenming Yang, Luoyang (CN)

(73) Assignee: LUOYANG JIANGUANG SPECIAL EQUIPMENT CO., LTD, Luoyang (CN)

( * ) Notice: Subject to any disclaimer, the term of this patent is extended or adjusted under 35 U.S.C. 154(b) by 585 days.

(21) Appl. No.: 14/007,011

(22) PCT Filed: Jan. 7, 2013

(86) PCT No.: PCT/CN2013/070140

§ 371 (c)(1),
(2) Date: Sep. 24, 2013

(87) PCT Pub. No.: WO2013/104288

PCT Pub. Date: Jul. 18, 2013

(65) Prior Publication Data

US 2014/0014491 A1 Jan. 16, 2014

(30) Foreign Application Priority Data

Jan. 10, 2012 (CN) ..... 2012 1 0005873

(51) Int. Cl.
*E21B 19/00* (2006.01)
*C10B 33/00* (2006.01)

(52) U.S. Cl.
CPC ..... *C10B 33/006* (2013.01)

(58) Field of Classification Search
CPC ..... C10B 33/006; C10B 33/14; E21B 19/08; E21B 19/22
USPC ..... 166/75.11, 77.51, 85.1, 90.1; 202/241
See application file for complete search history.

(56) References Cited

U.S. PATENT DOCUMENTS 6,913,096 B1 * 7/2005 Nielsen ..... E21B 19/16 166/77.51
2003/0051883 A1 * 3/2003 Seneviratne ..... E21B 21/02 166/380
2004/0253066 A1 12/2004 Paul

FOREIGN PATENT DOCUMENTS

CN 1535188 A 10/2004
CN 202082462 U 12/2011

(Continued)

OTHER PUBLICATIONS

Mar. 21, 2013 Search Report issued in International Patent Application No. PCT/CN2013/070140 (with translation).

*Primary Examiner* — Jill Warden
*Assistant Examiner* — Dwayne K Handy
(74) *Attorney, Agent, or Firm* — Oliff PLC

(57) ABSTRACT

A top drive mechanism for a drill rod for cutting of delayed coking units in the petroleum refining industry includes a gooseneck connector, a washpipe assembly, an output shaft, and a power mechanism for driving the output shaft to rotate. The output shaft has an integral structure formed by a shaft body and a flange; a step I is disposed on an outer circumferential surface of the output shaft; a support ring is disposed on an end face of the step I; the output shaft mates with the support ring through a key I; a lock nut fixes the support ring onto the end face of the step I; a lower portion of the support ring is provided with a self-aligning thrust roller bearing. The structure has high stability such that the service life of the top drive device is extended and installation and disassembly are easy and fast.

3 Claims, 3 Drawing Sheets

(56) References Cited

FOREIGN PATENT DOCUMENTS

| | | | |
|---|---|---|---|
| CN | 102517046 | A | 6/2012 |
| CN | 102517047 | A | 6/2012 |
| CN | 202415442 | U | 9/2012 |
| CN | 202415443 | U | 9/2012 |
| DE | 86 09 981.7 | U1 | 7/1986 |
| DE | 295 08 708 | U1 | 9/1995 |

* cited by examiner

TOP DRIVE MECHANISM FOR DRILL ROD

BACKGROUND

1. Technical Field

The present invention belongs to the technical field of hydraulic coke cutting of delayed coking units in the petroleum refining industry, and in particular, to a top drive mechanism for a drill rod.

2. Related Art

Delayed coking is a petroleum processing technology, and takes heavy oil as the raw material, which is rapidly heated to a coking reaction temperature through a heating furnace, and enters into a coke tower for a coking reaction. The heavy oil is subject to deep thermal cracking and condensation reactions; the produced gas, gasoline, diesel and gas oil pass through a pipeline to reach a downstream device and are processed in the downstream device, and the produced hundreds of tons of coke are left in the coke tower. The coke in the coke tower is gradually cooled to below 120° C. with steam and water; upper and lower seal bonnets of the coke tower are then opened, and a hydraulic coke remover is used to clean the coke in the coke tower; the upper and lower seal bonnets of the coke tower are then closed, and the process proceeds to a next production cycle: oil feeding, reaction, cooling, decoking, and so on.

The hydraulic coke remover usually includes: a decoking pump, a valve, a hose, a drill rod top drive, a drill rod, a coke remover, a winch, a pulley, and other devices. The decoking pump generates decoking water having certain energy, which passes through the valve, the hose, the drill rod top drive, and the drill rod into the coke remover, and is finally ejected from a nozzle of the coke remover. The coke remover has two groups of nozzles, i.e., drilling nozzles and cutting nozzles. Generally, when the hydraulic decoking begins, the drilling nozzle of the coke remover is used at first to eject the decoking water downward and drill a through hole with a diameter of about 1 m in the center of the coke tower, and the cutting nozzle of the coke remover is then used to eject decoking water toward two sides to gradually expand the channel; the coke is smashed in this process and flows out of the coke tower into a coke storage tank, and the decoking does not end until the coke in the coke tower is removed completely.

The drill rod top drive device is provided with a gooseneck connector and a high pressure hose. In decoking, the decoking water passes through the high pressure hose into a center channel on the top drive device and then passes through an output shaft of the drill rod top drive device into the drill rod and the coke remover. The output shaft of the drill rod top drive device is provided with a gear of a decelerator; the motor, after being decelerated by the gear, drives the output shaft to rotate the drill rod.

Currently, a threaded connection is employed between the output shaft of the drill rod top drive device for hydraulic decoking and the drill rod. During drilling, the coke sometimes may collapse and bury the coke remover, and removal of the coke remover requires repeated clockwise and counterclockwise rotation of the drill rod, so the threaded connection between the output shaft and the drill rod becomes unsuitable, and the threads are loosened easily; a lot of users use welding methods to prevent loosening, but this brings about difficulty when it is necessary to remove and replace the top drive or drill rod. Due to such reasons, the enterprises gradually use a flange connection, and the top drive device using a flange to connect a drill rod in the prior art mainly includes the following two structures: a. The employed output shaft structure is a stepped hollow shaft which is large in the middle and small at two ends, and the output shaft with such a structure has the following disadvantages: it is necessary to take apart the top drive device in installation, which not only is cumbersome but also is time-consuming and labor-consuming, and maintenance is very difficult; secondly, the axial force is unreasonable due to the supporting manner of the output shaft, rendering a high damage rate of the top drive device. b. A flange structure is disposed at a lower end of the output shaft, and the force is directly output to the flange structure through a power mechanism so as to drive the drill rod to rotate; as the supporting manner of the output shaft is also unreasonable, the output shaft is easily damaged, and the top drive device often needs to be maintained.

SUMMARY

An objective of the present invention is to solve the above technical problems, and a top drive mechanism for a drill rod is provided; the structure has high stability, and the supporting manner of the output shaft is so reasonable that the service life of the top drive device is extended and installation and removal is easy and fast.

In order to solve the above technical problem, the present invention adopts the following technical solution: a top drive mechanism for a drill rod, including a gooseneck connector, a washpipe assembly, an output shaft, a power mechanism for driving the output shaft to rotate, and a decelerator, where the gooseneck connector is connected with a high pressure pump through a high pressure hose; the washpipe assembly is connected between the gooseneck connector and the output shaft to achieve dynamic seal for the output shaft; the power mechanism is fixed onto a housing of the decelerator; an output end of the power mechanism is connected with a final gear disposed on the output shaft through the decelerator; the decelerator is fixedly disposed on a support; the gooseneck connector is fixedly provided with an upper cover plate connected with an elevating mechanism; the support and the upper cover plate are fixedly connected; a shell, located below the support, is disposed on the output shaft; the shell and the support are fixedly connected; a cavity that accommodates the final gear is formed between lower end faces of the shell and the support; the output shaft has an integral structure formed by a shaft body and a flange, and the shaft body has a stepped hollow structure; the flange is fixedly connected with the drill rod; an upper end of the shaft body passes through a bearing hole of the support to seal and butt a port of the washpipe assembly; a step I is disposed on an outer circumferential surface of the output shaft in the bearing hole; a support ring is disposed on an end face of the step I; a keyway is provided in an inner hole of the support ring; the output shaft mates with the support ring through a key I; the output shaft is further provided with a lock nut, and the lock nut fixes the support ring onto the end face of the step I; a lower portion of the support ring is provided with a self-aligning thrust roller bearing, and the self-aligning thrust roller bearing is disposed in the bearing hole of the support; an axial force of the output shaft is exerted on the support through the lock nut, the support ring, and the self-aligning thrust roller bearing; a step IV is disposed on an outer circumferential surface of the support ring, and a radial bearing I is disposed on an end face of the step IV.

The final gear mates with the output shaft through a key II; and a radial bearing II, located at a lower end of the final gear, is disposed in a bearing hole of the shell.

An oil-retaining ring is disposed between a lower end of the bearing hole of the support and the output shaft.

The lock nut is provided with a lock screw, and a lower end of the lock screw protrudes and butts against an end face of the support ring.

The beneficial effects of the present invention are as follows:

In the device, the output shaft is designed as a stepped hollow shaft with a large lower end and a small upper end; the large end of the output shaft is provided with a flange, and the flange is fixedly connected with the drill rod. The structure can not only achieve rapid connection but also achieve forward and reverse rotation of the drill rod during the operation, which greatly improves the production efficiency of the top drive device, and installation and removal of the structure is easy and fast. Secondly, the small end of the output shaft passes through the bearing hole of the support to seal and butt the washpipe assembly; a step I is disposed on an outer circumferential surface of the output shaft in the bearing hole; a support ring is disposed on an end face of the step I; the support ring and the output shaft coordinate with each other through a key, so as to prevent relative displacement between the support ring and the output shaft; a lock nut and a self-aligning thrust roller bearing are disposed sequentially, so that the axial force of the output shaft is exerted onto the support through the lock nut, the support ring and the self-aligning thrust roller bearing. The present invention adjusts the above components and disposes the components at optimal positions to match the structure of the output shaft with a large lower end and a small upper end, so that the output shaft with the structure has higher stability and the service life of the top drive device is extended.

Figure 1:
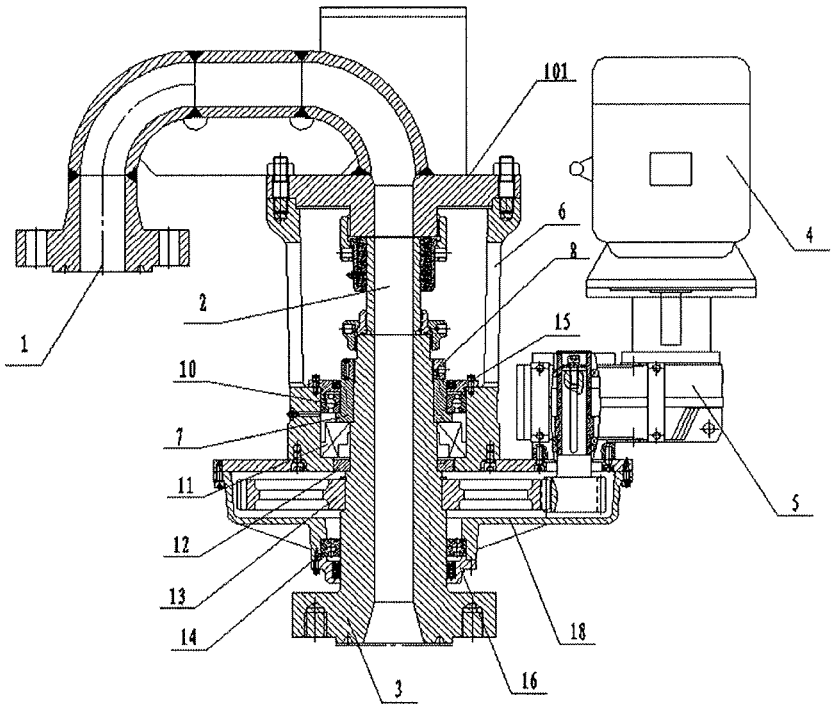
FIG. 1 is a schematic structural view of the present invention.
Figure 2:
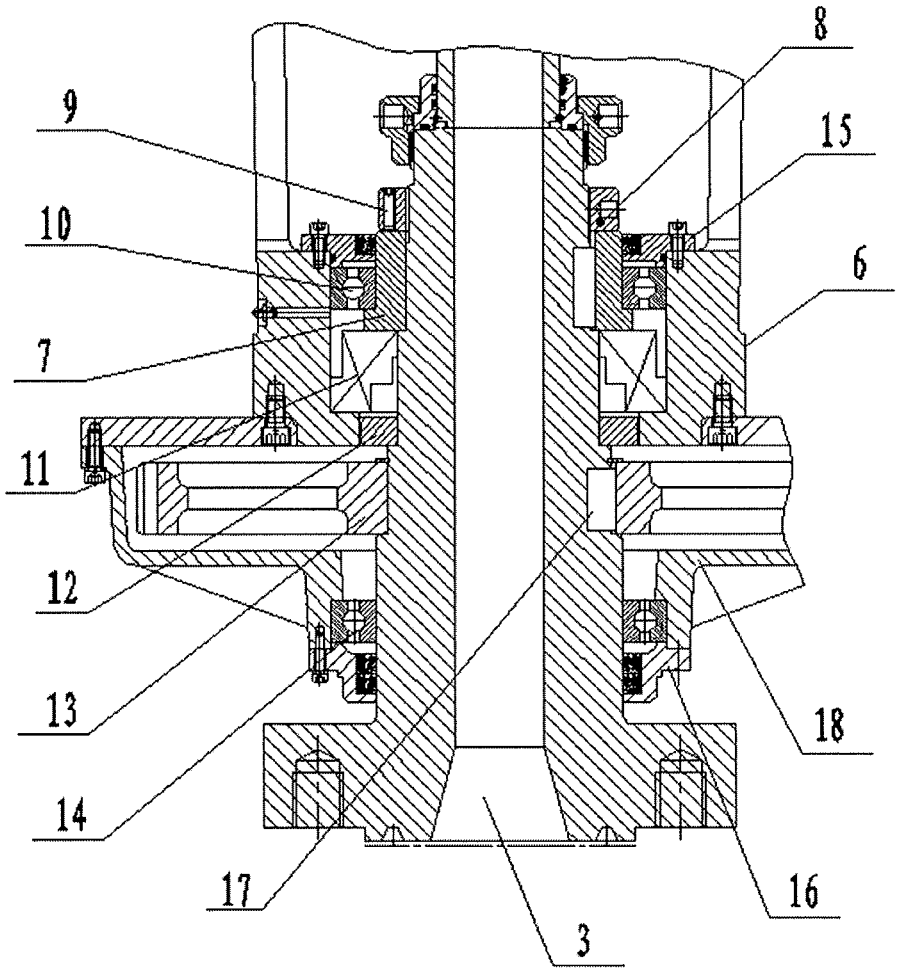
FIG. 2 is a local enlarged view of an output shaft in FIG. 1.
Figure 3:
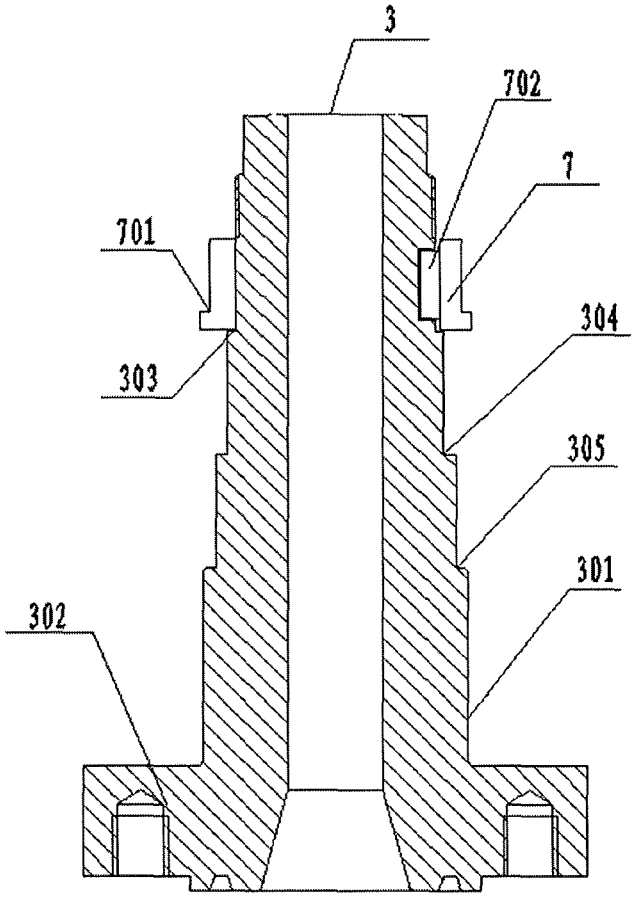
FIG. 3 is a schematic structural view of an output shaft.

Reference signs: 1: Gooseneck connector, 101: Upper cover plate, 2: Washpipe assembly, 3: Output shaft, 301. Shaft body, 302: Flange, 303: Step I, 304: Step II, 305: Step III, 4: Power mechanism, 5: Decelerator, 6: Support, 7: Support ring, 701: Step IV, 702: Key I, 8: Lock nut, 9. Lock screw, 10: Radial bearing I, 11: Self-aligning thrust roller bearing, 12: Oil-retaining ring, 13: Final gear, 14: Radial bearing II, 15: Upper end cover, 16: Lower end cover, 17: Key II, 18: Shell.

DETAILED DESCRIPTION

As shown in the figures, a top drive mechanism for a drill rod includes a gooseneck connector 1, a washpipe assembly 2, an output shaft 3, a power mechanism 4 for driving the output shaft to rotate, and a decelerator 5. The power mechanism may use a drive member such as a motor. The gooseneck connector 1 is connected with a high pressure pump through a high pressure hose. The washpipe assembly 2 is connected between the gooseneck connector 1 and the output shaft 3 to achieve dynamic seal for the output shaft, and the washpipe assembly belongs to the prior art. The power mechanism 4 is fixed onto a housing of the decelerator 5, and an output end of the power mechanism is connected with a final gear 13 disposed on the output shaft 3 through the decelerator 5. A lower end of the decelerator is fixedly disposed on a support 6. The gooseneck connector 1 is fixedly provided with an upper cover plate 101 connected with an elevating mechanism, and an upper end of the support 6 is fixedly connected with the upper cover plate 101. A shell 18, located below the support 6, is disposed on the output shaft 3, and circumference of the shell 18 is fixedly connected with the support 6 through a bolt component. Thus, the gooseneck connector 1, the washpipe assembly 2, the output shaft 3, the power mechanism 4, the decelerator 5, the support 6, and the shell 18 form an integral structure, to drive the above components to be displaced up and down through the elevating mechanism. A cavity that accommodates the final gear 13 is formed between lower end faces of the shell 18 and the support 6, and the cavity may store a lubricant to make the final gear 13 in a better working status.

The output shaft 3 has an integral structure formed by a shaft body 301 and a flange 302, and the shaft body 301 has a stepped hollow structure with a large lower end and a small upper end. The lower end of the shaft body 301 is connected with the flange 302, and the flange 302 is fixedly connected with the drill rod. The upper end of the shaft body 301 passes through a bearing hole of the support 6 to seal and butt a port of the washpipe assembly 2. A step I 303, a step II 304, and a step III 305 are sequentially disposed on an outer circumferential surface of the output shaft from the small end to large the end. The step I 303 is located in the bearing hole of the support 6, and a support ring 7 is disposed on an end face of the step I 303. A keyway is provided in an inner hole of the support ring 7. The output shaft 3 mates with the support ring 7 through a key I 702. The output shaft 3 is further provided with a lock nut 8, and the lock nut 8 fixes the support ring 7 onto the end face of the step I 303. The lock nut 8 is further provided with a lock screw 9, and a lower end of the lock screw 9 protrudes and butts against an end face of the support ring 7. A lower portion of the support ring 7 is provided with a self-aligning thrust roller bearing 11, and the self-aligning thrust roller bearing 11 is disposed in the bearing hole of the support 6. An axial force of the output shaft is exerted on the support 6 through the lock nut 8, the support ring 7 and the self-aligning thrust roller bearing 11. The support 6 transfers the axial force to the elevating mechanism through the upper cover plate 101. A step IV 701 is disposed on an outer circumferential surface of the support ring 7, and a radial bearing I 10 is disposed on an end face of the step IV 701. An oil-retaining ring 12 is disposed between a lower end of the bearing hole of the support 6 and the output shaft, and the oil-retaining ring 12 is disposed on an end face of the step II 304. An upper end of the bearing hole is provided with an upper end cover 15, and an oil seal is provided between an inner circumferential surface of the upper end cover 15 and an outer circumferential surface of the support ring 7.

The final gear 13 mates with the output shaft 3 through a key II 17, and the final gear 13 defines its axial displacement through the step III 305. Therefore, a power output end of the power mechanism 4 is connected with the final gear 13 through a gear pair in the decelerator, and transfers power to the output shaft. A radial bearing II 14, located at a lower end of the final gear, is disposed in a bearing hole of the shell 18. A lower end of the bearing hole of the shell 18 is provided with a lower end cover 16, and an oil seal is provided between an inner circumferential surface of the lower end cover 16 and an outer circumferential surface of the output shaft 3. The radial bearing I 10 and the radial bearing II 14 may be any bearing that can withstand radial forces, for example, a deep groove ball bearing.

The support 6 and the shell 18 are each provided with an oiling hole, and the oiling holes respectively communicate with the bearing holes of the support 6 and the shell 18.

What is claimed is:

1. A top drive mechanism for a drill rod, comprising a gooseneck connector, a washpipe assembly, an output shaft, a power mechanism for driving the output shaft to rotate, and a decelerator, wherein the gooseneck connector is connected with a high pressure pump through a high pressure hose; the washpipe assembly is connected between the gooseneck connector and the output shaft to achieve dynamic seal for the output shaft; the power mechanism is fixed onto a housing of the decelerator; an output end of the power mechanism is connected with a final gear disposed on the output shaft through the decelerator; the decelerator is fixedly disposed on a support; the gooseneck connector is fixedly provided with an upper cover plate connected with an elevating mechanism; the support and the upper cover plate are fixedly connected; a shell, located below the support, is disposed on the output shaft; the shell and the support are fixedly connected, and a cavity that accommodates the final gear is formed between lower end faces of the shell and the support, wherein: the output shaft has an integral structure formed by a shaft body and a flange; the shaft body has a stepped hollow structure; the flange is fixedly connected with the drill rod; an upper end of the shaft body passes through a bearing hole of the support to seal and butt a port of the washpipe assembly; a step I is disposed on an outer circumferential surface of the output shaft in the bearing hole; a support ring is disposed on an end face of the step I; a keyway is provided in an inner hole of the support ring; the output shaft mates with the support ring through a key I; the output shaft is further provided with a lock nut, and the lock nut fixes the support ring onto the end face of the step I; a lower portion of the support ring is provided with a self-aligning thrust roller bearing, and the self-aligning thrust roller bearing is disposed in the bearing hole of the support; an axial force of the output shaft is exerted on the support through the lock nut, the support ring, and the self-aligning thrust roller bearing, a step IV is disposed on an outer circumferential surface of the support ring, and a radial bearing I is disposed on an end face of the step IV; and the final gear mates with the output shaft through a key II, and a radial bearing II, located at a lower end of the final gear, is disposed in a bearing hole of the shell.

2. The top drive mechanism for a drill rod according to claim 1, wherein, an oil-retaining ring is disposed between a lower end of the bearing hole of the support and the output shaft.

3. The top drive mechanism for a drill rod according to claim 2, wherein, the lock nut is provided with a lock screw, and a lower end of the lock screw protrudes and butts against an end face of the support ring.

* * * * *